US011470414B2

(12) United States Patent
Skovgaard

(10) Patent No.: US 11,470,414 B2
(45) Date of Patent: Oct. 11, 2022

(54) EARPHONE AND METHOD FOR MANUFACTURING AN EARPHONE

(71) Applicant: Goertek Inc., Shandong (CN)

(72) Inventor: Frederik Skovgaard, Shandong (CN)

(73) Assignee: Goertek Inc., Weifang (CN)

( * ) Notice: Subject to any disclaimer, the term of this patent is extended or adjusted under 35 U.S.C. 154(b) by 76 days.

(21) Appl. No.: 17/040,659

(22) PCT Filed: Sep. 12, 2018

(86) PCT No.: PCT/CN2018/105313

§ 371 (c)(1),
(2) Date: Sep. 23, 2020

(87) PCT Pub. No.: WO2020/051811

PCT Pub. Date: Mar. 19, 2020

(65) Prior Publication Data

US 2021/0021922 A1 Jan. 21, 2021

(51) Int. Cl.
*H04R 1/10* (2006.01)

(52) U.S. Cl.
CPC ..... *H04R 1/1016* (2013.01); *H04R 1/1075* (2013.01); *H04R 2400/11* (2013.01)

(58) Field of Classification Search
CPC ..... H04R 1/1016; H04R 1/1075; H04R 2400/11; H04R 1/2823; H04R 1/086; H04R 2201/107; H04R 2460/11
USPC ..... 381/182, 371, 370
See application file for complete search history.

(56) References Cited

U.S. PATENT DOCUMENTS

| | | | | |
|---|---|---|---|---|
| 9,838,777 | B2 * | 12/2017 | Kuwahara | H04R 1/1041 |
| 10,484,766 | B2 | 11/2019 | Huo et al. | |
| 2005/0271226 | A1 * | 12/2005 | Tanabu | H04R 9/063 381/396 |
| 2014/0056455 | A1 * | 2/2014 | Sakaguchi | H04R 1/2811 381/328 |
| 2016/0314779 | A1 * | 10/2016 | Huang | G10K 11/17885 |
| 2018/0152790 | A1 | 5/2018 | Dong et al. | |
| 2018/0270558 | A1 * | 9/2018 | Ring | H04R 1/02 |
| 2019/0058933 | A1 | 2/2019 | Huo et al. | |
| 2019/0253788 | A1 | 8/2019 | Pierce | |

FOREIGN PATENT DOCUMENTS

| | | | |
|---|---|---|---|
| CN | 105592389 | A | 5/2016 |
| CN | 106060727 | A | 10/2016 |
| WO | WO 2017/148009 | A1 | 9/2017 |
| WO | WO 2018/075805 | A1 | 4/2018 |

* cited by examiner

*Primary Examiner* — Alexander Krzystan
*Assistant Examiner* — Julie X Dang
(74) *Attorney, Agent, or Firm* — Baker Botts, L.L.P.

(57) ABSTRACT

An earphone and a method for manufacturing an earphone are disclosed. The earphone comprises, a housing, including an outer housing and/or an inner housing, and a speaker unit, including a static structural part, wherein at least one portion of the static structural part is integrated with at least one part of the outer housing and/or inner housing.

13 Claims, 3 Drawing Sheets

EARPHONE AND METHOD FOR MANUFACTURING AN EARPHONE

CROSS-REFERENCE TO RELATED APPLICATIONS

This application is a National Stage of International Application No. PCT/CN2018'105313, filed on Sep. 12, 2018, which is hereby incorporated by reference in its entirety.

FIELD OF THE INVENTION

The present invention relates to technical field of earphone, and more specifically, to an earphone and a method for manufacturing an earphone.

BACKGROUND OF THE INVENTION

In most earphones, such as ear buds and even full-size headphones, excessive structural parts are needed in a typical earphone assembly. The traditional solutions reduce the number of components simply by making the outer housing be either one or multiple pieces. It does not work well and cause size limitations which limit the minimum size, ergonomics, and aesthetics.

SUMMARY OF THE INVENTION

One object of this invention is to provide a new technical solution for an earphone.

According to a first aspect of the present invention, there is provided an earphone, comprising: a housing, including an outer housing and/or an inner housing; and a speaker unit, including a static structural part, wherein at least one portion of the static structural part is integrated with at least one part of the outer housing and/or inner housing.

According to a second aspect of the present invention, there is provided a method for manufacturing an earphone, comprising: providing a housing including an outer housing and/or an inner housing; forming a static structural part of a speaker unit by integrating at least one portion of the static structural part with at least one part of the outer housing and/or inner housing; and mounting other components of the speaker unit into the housing.

According to an embodiment of this disclosure, the size of an earphone may be reduced and design constrains may be lowered for a give driver size.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

Figure 1:
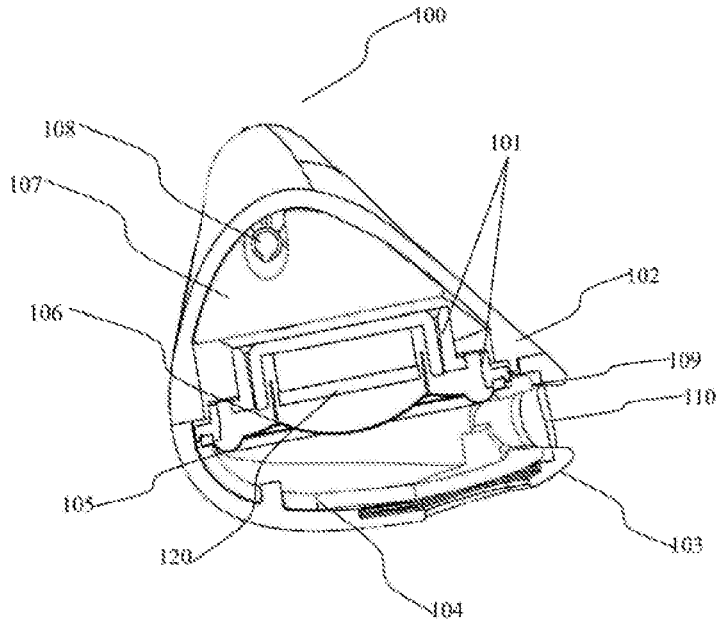
FIG. 1 is a schematic cross-section view of a prior art earphone.
Figure 2:
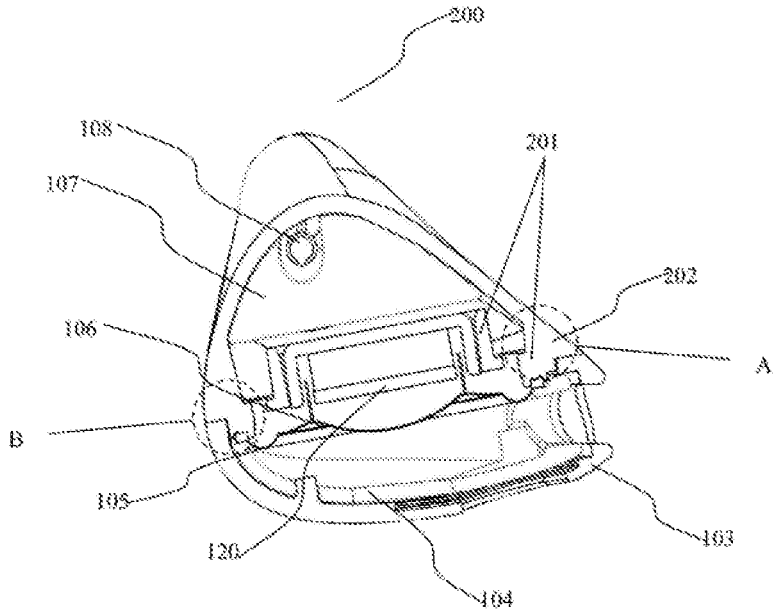
FIG. 2 is a schematic cross-section view of an earphone according to an embodiment of this disclosure.

FIG. 2 is a schematic cross-section view of an earphone 200 according to an embodiment of this disclosure, and FIG. 1 is a schematic cross-section view of a prior art earphone.

The embodiment of FIG. 2 will be described in comparison with FIG. 1. As shown in FIG. 2, the earphone 200 comprises: a housing, including an outer housing 202, 103 and/or an inner housing 104; and a speaker unit 120, including a static structural part. At least one portion of the static structural part is integrated with at least one part of the outer housing and/or inner housing.

This embodiment combines parts of the speaker unit with parts of the outer and or inner housing, basically joining two parts from two completely different domains of an earphone, namely the speaker unit and either inner or outer housing parts, reducing the number of parts needed and reducing the amount of interfaces, thus eliminates size limitations in the traditional solution, meets the needs of ergonomics and aesthetics. While as shown in FIG. 1, in the earphone 100 of the prior art, parts from one domain are relatively separated from those of another domain, for example, the speaker unit 120 is generally an independent unit in an earphone. It is a separate part from the mechanical parts of a housing used for an earphone. Besides, the basket 101 is separate from the outer rear housing part 102. Corresponding parts like an outer housing 102, 103, an inner housing 104, a speaker unit 120, an outer rear housing part 102, an outer front housing part 103, an inner front housing part 104, a basket 101, a surround 105, a diaphragm 106, terminator components 107, a cable 108, a mesh carrier 109 and an acoustic mesh 110, are indicated in the example showed by FIG. 1 and the indicators are adopted by the earphones of the present disclosure in FIGS. 2-4. However, it mainly intends for an easy comparison on the structure change, and should not be understood to be a limitation of the function or implementation of this disclosure.

Further, a speaker unit of an earphone in this embodiment has at least one static structure part. At least one part of the static structure part is connected to or is fixed on the housing. The at least one part of the static structure part for being connected to or being fixed on the housing can be of the same material as that of at least one part of the housing. When the at least one part of the static structure part is integrated with at least one part of the housing, they are reduced into one element. Consequently, the connection structure between the static structure part and the housing may be omitted. Furthermore, the omitted part may be thinned so that a designer may use it for other component or the overall size of the earphone may be reduced. Besides, this integration may provide a more stable support or fixture to the speaker unit inside the housing.

The earphone may be an in-ear bud, a semi-in-ear bud, a headphone, a headset and so on.

The earphone 200 may also comprises the components of a prior art earphone such as those shown in FIG. 1. As shown in FIG. 2, the outer housing includes an outer rear housing part 202 and an outer front housing part 103. The inner housing includes an inner front housing part 104 and so on.

The speaker unit 120 can be a component in an earphone, which packages an electro-acoustic transducer/driver that converts electrical signals into sounds and other parts that may be needed for an earphone, which are not closely relevant and will not be discussed in this disclosure. The speaker unit 120 may comprise a basket 201, a surround 105, a diaphragm 106 and terminator components 107. The speaker unit 120 may further include a carrier ring (not shown) against the diagram to fix the diagram 106 on the basket 201, a coil, a coil former, a magnet and so on, as explained above. The earphone 200 may further comprise a cable 108, a mesh carrier 109 and an acoustic mesh 110 as those shown in FIG. 1.

The basket 101/201 is a structure to support the driver components of a speaker unit 120. It is a main carrier for driver components. It is usually the largest static structural part of the speaker unit. It can suspend the magnet of a speaker unit in the correct place in relation to the diaphragm 106, the surround 105 and so on. Furthermore, the terminator components 107 are used to connect to signals lines from the cable 108 and are also a static structure for holding the connection points in place.

The mesh carrier 109 is a structure for supporting and holding an acoustic mesh. The acoustic mesh 110 is usually attached to a metal or metallized plastic mesh with double sided adhesive tape. This stack structure is held in place by the mesh carrier 109.

The acoustic mesh 110 may be used to tune the frequency response of the system (earphone) and/or to keep out dust rind other debris. In some applications, the acoustic mesh 110 may be used for water ingress protection.

Further, the speaker unit 120 may be a driver, and the driver includes the basket 101/201, the surround 105, the diaphragm 106, the terminator components 107, the carrier ring, the coil, the coil former, the magnet and so on.

The driver provides the static structural part, which may be the basket 101/102 and/or a terminator component 107. At least one portion of the static structural part from the driver is integrated with at least one part of the outer housing 202, 103 and/or inner housing is 104.

The speaker unit 120 may further include a carrier ring (not shown) against the diagram to fix the diagram 106 on the basket 101/201, a coil, a coil former, a magnet and so on.

From the embodiments above, it can be known that the earphone may have one of the following structure:

at least one portion of the basket and/or terminator component is integrated with at least one part of the outer housing;

at least one portion of the basket and/or terminator component is integrated with at least one part of the inner housing;

at least one portion of the basket and/or a terminator component is integrated with at least one part of the outer housing and one part of inner housing meantime.

Further, in an example the outer housing includes an outer rear housing part 202. The static structural part is the basket 201 for carrying other components of the speaker unit 120, and at least one portion of the basket 201 is integrated with the outer rear housing part 202. The integration portions are shown by "A" and "B" in FIG. 2.

This gives a designer more freedom and allows for a reduction of total parts, sub assemblies, and assembly time.

Here, the specific manufacture process of integrating the outer housing and: or inner housing with the static structural part is not limited in these embodiments, and all kinds of means that can achieve the combination could be adopted.

In this embodiment, parts of the speaker unit are combined with parts of the housing, such as an outer housing part or an inner housing part. Different from the prior art, this embodiment basically joins two parts from two completely different domains (namely a speaker unit and a housing, either inner or outer housing parts).

In the prior art, the inner front housing part is used as a support part, which interfaces with the speaker unit to fix it in the housing of the earphone. It provides a mating face to the front of the speaker unit, which allows for a seal of the speaker unit between front and rear housing parts. The inner front housing part is now over-complicated as one of its main uses is to interface with the speaker unit.

In a further embodiment, when the basket 201 is integrated with the rear housing part and can be used to fix the speaker unit, this function of the inner front housing part of interfacing with the speaker unit is not needed.

For example, the inner housing includes the inner front housing part 104 and the inner front housing part 104 may be used as a mesh carrier, without supporting the speaker unit 120. This is a much simpler structure. This will reduce the parts in the earphone and the space thereof can be saved. This may also lead to a very simple acoustic mesh retainer mechanism that is easy to mount to save production time. Alternatively, the inner front housing part 104 may be used as a mesh carrier and is used for supporting the speaker unit 120, to give a stronger support to the speaker unit.

Further, in an example the outer housing includes the outer rear housing part 202. The static structural part is the terminator component 107 of the speaker unit 120. The terminator component 107 is integrated with the outer rear housing part 202.

In this embodiment, since the parts of the speaker unit 120 are combined with parts of the housing, the overall size of the speaker can be reduced and design constraints inherited from a given speaker unit size can be lowered. As such, the space, parts and interfaces in an earphone could be saved. For example, less area in the earphone will have double wall thickness and the space thereof may be saved. Furthermore, the tolerance chain length can also be reduced.

Alternatively, the saved space may be used for other features, such as topology optimization, to improve both acoustics and ergonomics.

Figure 3:
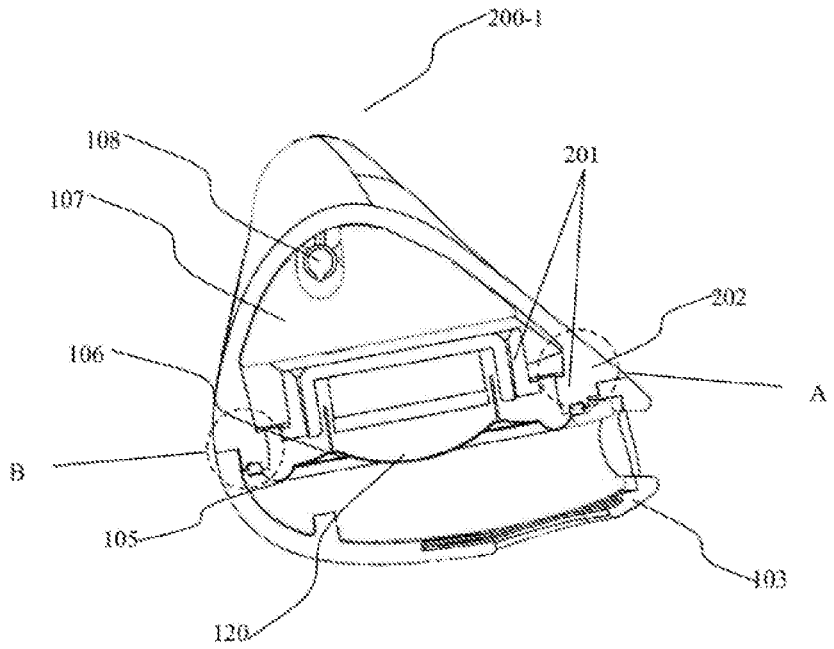
FIG. 3 is a schematic cross-section view of an earphone according to a further embodiment of this disclosure.

FIG. 3 is a schematic cross-section view of an earphone 200-1 according to a further embodiment of this disclosure. The repetitive description with respect to the above contents will be omitted.

As shown in FIG. 3, the housing just includes the outer rear housing part 202 and the outer front housing part 103 without the inner front housing part 104. That is, the housing of the earphone 200-1 includes an outer housing 202, 103, without the inner housing (the inner front housing 104). As described above, this is feasible because the basket 201 is integrated with the rear housing part 202 and the integration can be used to fix the speaker unit 200-1. This will further save the space of the earphone.

Figure 4:
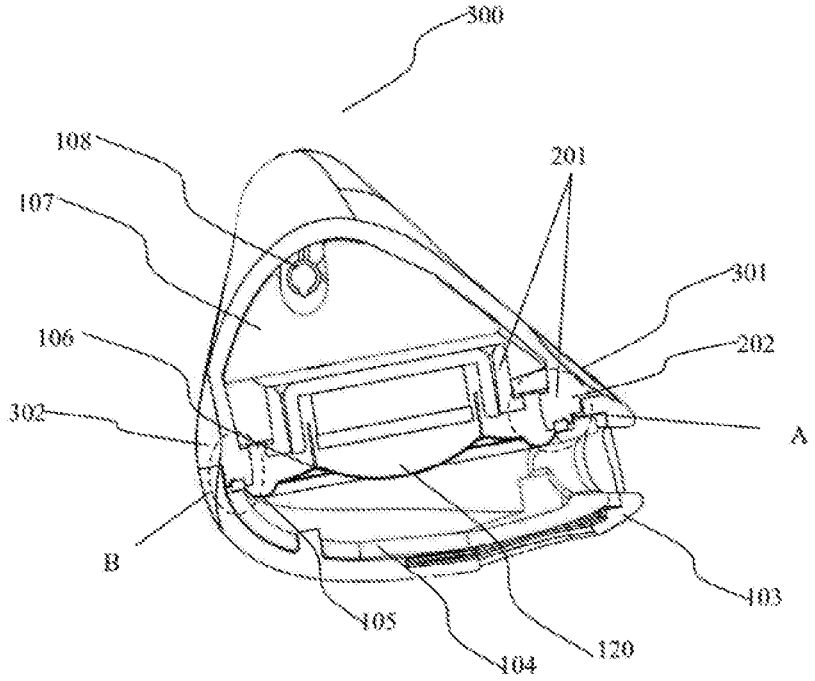
FIG. 4 is a schematic cross-section view of an earphone according to a further embodiment of this disclosure.

FIG. 4 is a schematic cross-section view of an earphone 300 according to a further embodiment of this disclosure. The repetitive description with respect to the above contents will be omitted.

As shown in FIG. 4, the housing is thinned at a position where at least one portion of the static structural part is integrated with at least one part of the outer housing and/or inner housing. In FIG. 3, the thinned portions 301 and 302 are located on the outer rear housing part 202 and correspond to the integration portions "A" and "B".

This thinning may be presented through several ways. For example, it can be presented through the changes in outer and/inner profile.

Since the parts and interfaces are reduced, less overlapping structures will be present in the earphone. As a result, the thickness of the design for an earphone can be reduced. This opens up for a greater freedom for aesthetics and ergonomics. In an example of an earbud, the thickness of housing will be narrowed 1 mm, which enables the design to have a 7% smaller middle section.

Because the earphone is generally small, it is very difficult to make an improvement in this limited design space. In view of this, these changes in the above embodiment could produce a significant impact on the design and the using experiences of a user.

Figure 5:
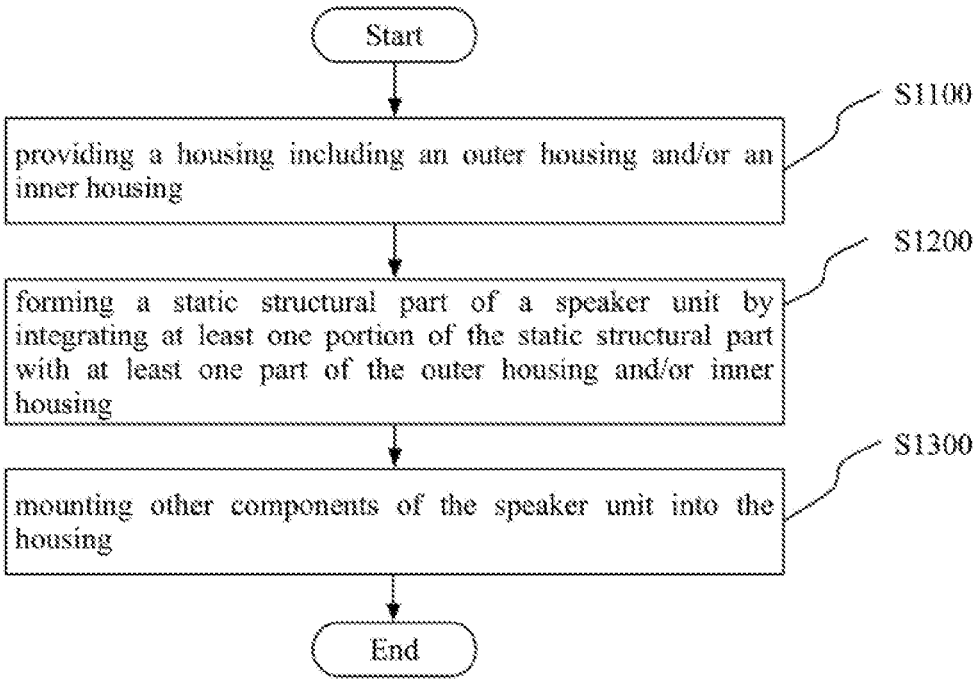
FIG. 5 schematically shows a flow chart of a method for manufacturing an earphone according to another embodiment of this disclosure.

FIG. 5 schematically shows a flow chart of a method for manufacturing an earphone according to another embodiment of this disclosure. The repetitive description with respect to the above contents will be omitted.

At step S1100, a housing including an outer housing and/or an inner housing is provided.

At step S1200, a static structural part of a speaker unit is formed by integrating at least one portion of the static structural part with at least one part of the outer housing and/or the inner housing.

At step S1300, other components of the speaker unit are mounted into the housing.

Compared with the prior art of using a separate speaker unit, this approach needs to is change the procedure of assembling the speaker unit. However, because this change will produce a big benefit to the design of earphone, it is worth making this change.

This embodiment combines parts of the speaker unit with parts of the outer and/or inner housing, basically joining two parts from two completely different domains of an earphone, namely speaker unit and either inner or outer housing parts, reducing the number of parts needed and reducing the amount of interfaces, thus eliminates size limitations in the traditional solution, meets the needs of ergonomics and aesthetics.

For example, the outer housing includes an outer rear housing part, and the static structural part is a basket for carrying other components of the speaker unit. The forming a static structural part of a speaker unit may further comprise: forming the basket by integrating at least one portion of the basket with the outer rear housing part.

For example, the inner housing includes an inner front housing part, and at step S1100 the providing a housing further comprises: forming the inner front housing part as mesh carrier, without supporting the speaker unit.

For example, the inner housing includes an inner front housing part, and at step S1100 the providing a housing further comprises: forming the inner front housing part as a mesh carrier and for supporting the speaker unit.

For example, the outer housing includes an outer rear housing part, and the static structural part is a terminator component of the speaker unit. In step S1200, the forming a static structural part of a speaker unit further comprises: forming the terminator component by integrating the terminator component with the outer rear housing part.

For example, the method may further comprise: thinning the housing at a position where at least one portion of the static structural part is integrated with at least one part of the outer housing and/or inner housing.

For example, the forming a static structural part of a speaker unit may further comprising: choosing a basket and/or a terminator component of the speaker unit as the static structural part; and integrating at least one portion of a basket and/or a terminator component with at least one part of the outer housing and/or inner housing.

The advantages and specific processes of these method embodiments can refer to those relative contents in the above product embodiments.

Although some specific embodiments of the present invention have been demonstrated in detail with examples, it should be understood by a person skilled in the art that the above examples are only intended, to be illustrative but not to limit the scope of the present invention.

What is claimed is:

1. An earphone, comprising:

a housing, including at least one of an outer housing and an inner housing; and a speaker unit, including a static structural part, wherein at least one portion of the static structural part is integrated with at least one part of the outer housing and/or inner housing, and wherein the housing is thinned at a position where at least one portion of the static structural part is integrated with at least one part of the outer housing and/or inner housing, and thinning can be presented through the changes in outer and/or inner profile of the housing.

2. The earphone according to claim 1, wherein the speaker unit includes a driver, and the driver provides the static structural part; and at least one portion of the static structural part from the driver is integrated with at least one part of the outer housing and/or inner housing.

3. The earphone according to claim 1, wherein the outer housing includes an outer rear housing part, the static structural part is a basket for carrying other components of the speaker unit, and at least one portion of the basket is integrated with the outer rear housing part.

4. The earphone according to claim 1, wherein the inner housing further includes an inner front housing part, and wherein the inner front housing part is used as a mesh carrier, without supporting the speaker unit.

5. The earphone according to claim 1, wherein the inner housing thither includes an inner front housing part, and wherein the inner front housing part is used as a mesh carrier and is used for supporting the speaker unit.

6. The earphone according to claim 1, wherein the outer housing includes an outer rear housing part, the static structural part is a terminator component of the speaker unit, and the terminator component is integrated with the outer rear housing part.

7. The earphone according to claim 1, wherein the static structural part comprises at least one of a basket and a terminator component of the speaker unit, and at least one portion of a basket and/or a terminator component is integrated with at least one part of the outer housing and/or inner housing.

8. A method for manufacturing an earphone, comprising:

providing a housing including at least one of an outer housing and an inner housing;

forming a static structural part of a speaker unit by integrating at least one portion of the static structural part with at least one part of the outer housing and/or the inner housing;

mounting other components of the speaker unit into the housing; and thinning the housing at a position where at least one portion of the static structural part is integrated with at least one part of the outer housing and/or inner housing, wherein thinning can be presented through the changes in outer and/or inner profile of the housing.

9. The method according to claim 8, wherein the outer housing includes an outer rear housing part, and the static structural part is a basket for carrying other components of the speaker unit; and wherein forming a static structural part of a speaker unit further comprises: forming the basket by integrating at least one portion of the basket with the outer rear housing part.

10. The method according to claim 8, wherein the inner housing further includes an inner front housing part, and wherein providing a housing further comprises: forming the inner front housing part as a mesh carrier, without supporting the speaker unit.

11. The method according to claim 8, wherein the inner housing further includes an inner front housing part, and wherein providing a housing further comprises: forming the inner front housing part as a mesh carrier and for supporting the speaker unit.

12. The method according to claim 8, wherein the outer housing includes an outer rear housing part, and the static structural part is a terminator component of the speaker unit; and wherein forming a static structural part of a speaker unit further comprises: forming the terminator component by integrating the terminator component with the outer rear housing part.

13. The method according to claim 8, wherein the forming a static structural part of a speaker unit further comprises:

choosing a basket and/or a terminator component of the speaker unit as the static structural part; and integrating at least one portion of a basket and/or a terminator component with at least one part of the outer housing and or inner housing.

* * * * *